United States Patent [19]

Porat

[11] Patent Number: 4,929,926

[45] Date of Patent: May 29, 1990

[54] INTRUSION DETECTION BARRIER

[75] Inventor: Chaim Porat, Beer Sheba, Israel

[73] Assignee: Magal Security Systems, Ltd., Israel

[21] Appl. No.: 337,675

[22] Filed: Apr. 13, 1989

[30] Foreign Application Priority Data

May 6, 1988 [IL] Israel ..... 86294

[51] Int. Cl.[5] ..... G08B 13/00; H01H 3/02

[52] U.S. Cl. ..... 340/541; 200/61.93; 340/668

[58] Field of Search ..... 340/541, 668; 200/61.93; 256/10

[56] References Cited

U.S. PATENT DOCUMENTS

| | | | |
|---|---|---|---|
| 4,155,083 | 5/1979 | Slaats et al. | 340/541 X |
| 4,367,459 | 1/1983 | Amir et al. | 340/541 |
| 4,500,873 | 2/1985 | Porat et al. | 340/668 X |
| 4,503,423 | 3/1985 | Mainiero et al. | 340/552 |
| 4,525,701 | 6/1985 | Leih | 340/541 |
| 4,527,150 | 7/1985 | Porat | 340/541 |
| 4,680,573 | 7/1987 | Ciordinik et al. | 340/541 |
| 4,703,313 | 10/1987 | Husmann et al. | 340/668 X |
| 4,730,809 | 3/1988 | Stoler | 340/668 X |

FOREIGN PATENT DOCUMENTS

| | | | |
|---|---|---|---|
| 2039683 | 8/1980 | United Kingdom | 340/550 |

*Primary Examiner*—Joseph A. Orsino
*Assistant Examiner*—Thomas J. Mullen, Jr.
*Attorney, Agent, or Firm*—Benjamin J. Barish

[57] ABSTRACT

An intrusion detection barrier, comprises a coiled wire fence deployable over the ground or over another fence, a sensor wire tensioned between a pair of wire-supporting posts anchored in the ground, an intrusion detector connected to the sensor wire to sense any change in tension thereof, and coupling members coupling the sensor wire to spaced points of the coiled wire fence. Each of the coupling members permits free movement of the sensor wire with respect to the coiled wire fence in the direction of the longitudinal axis of the sensor wire, but restrains movement of the sensor wire with respect to the coiled wire fence in the direction transversely to the longitudinal axis of the sensor wire.

20 Claims, 1 Drawing Sheet

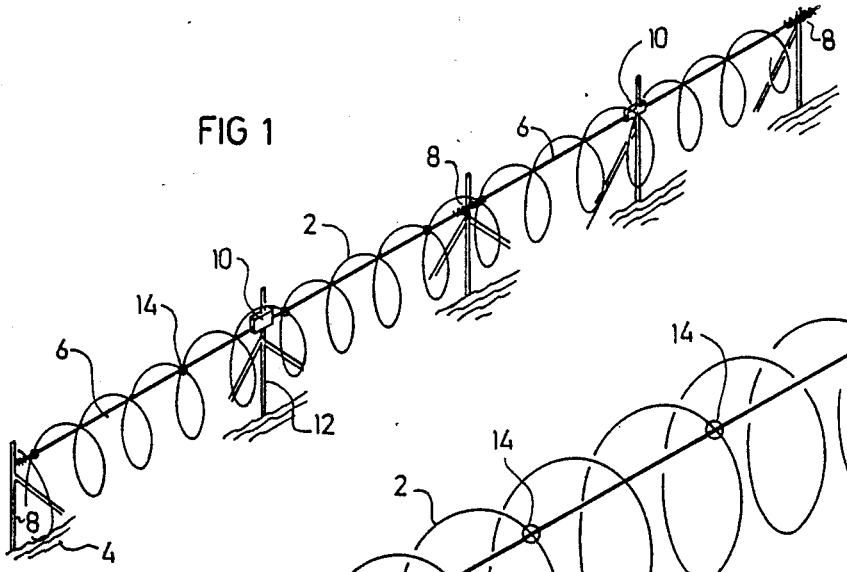
FIG 1
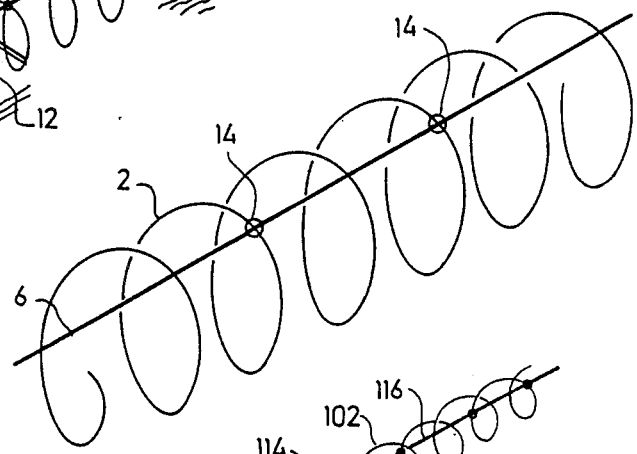
FIG 2
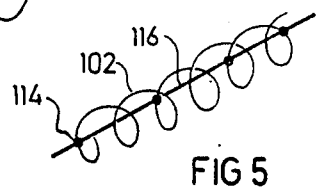
FIG 5
FIG 3
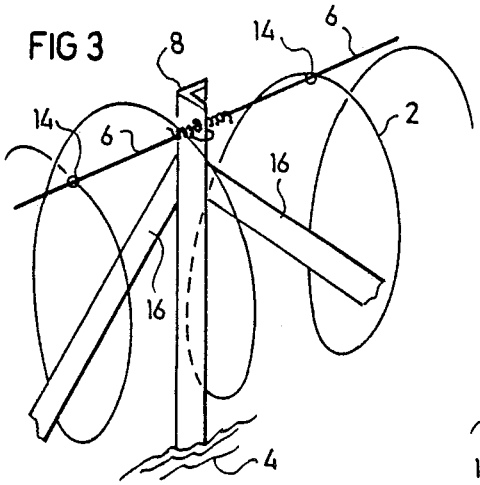
FIG 4
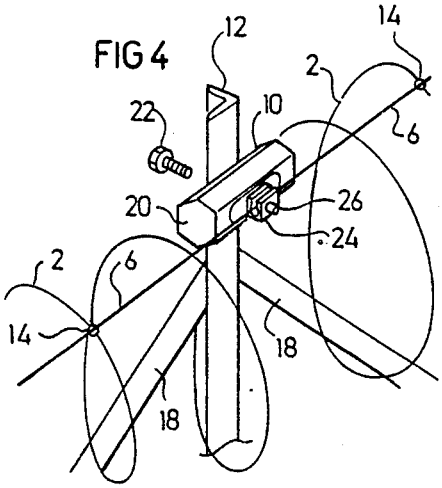

INTRUSION DETECTION BARRIER

BACKGROUND OF THE INVENTION

The present invention relates to intrusion detection barriers, and particularly to a deployable barrier, such as a coiled wire fence, equipped with means for detecting any attempted intrusion thereof.

Coiled wire fences, e.g., of the barbed wire or the razor foil type and sometimes called "concertina" fences, are widely used as deployable barriers which can be moved from one location to another according to the need, and also as an additionl barrier over another fence to give added protection in depth. It is desirable to equip such fences with intrusion detection sensors which will actuate an alarm or otherwise provide an indication when an intrusion of the barrier is attempted. One way of equipping deployable coiled wire fences with intrusion detectors is to provide them with vibration-type sensors which when subjected to vibrations over a threshold value sound an alarm. However, such systems tend to produce a large number of false alarms, e.g., because of the wind. Other systems include an arrangement which creates an electrostatic field within the coiled wire barrier, which electrostatic field is disturbed when an intrusion is attempted, but such systems are not only very expensive but also tend to produce a large number of false alarms. A still further proposed system includes microphones attached to the coiled wire fence, but such systems suffer from the same drawbacks of high expense and high rate of false alarms.

An object of the present invention is to provide a deployable or permanent intrusion detection barrier having advantages in the above respects. More particularly, an object of the invention is to provide a deployable intrusion detection barrier which is relatively simple and inexpensive to produce and to deploy, and which is characterized by a relatively low rate of false alarms, as compared to the above-mentioned systems.

BRIEF SUMMARY OF THE INVENTION

According to the present invention, there is provided an intrusion detector barrier comprising: a coiled wire fence deployable over the ground or over another fence; a sensor wire tensioned between a pair of wire-supporting posts anchored in the ground; an intrusion detector connected to the sensor wire to sense any change in tension thereof; and coupling members coupling the sensor wire to spaced points of the coiled wire fence.

Preferably, each of the coupling members permits free movement of the sensor wire with respect to the coiled wire fence in the direction of the longitudinal axis of the sensor wire, but restrains movement of the sensor wire with respect to the coiled wire fence in the direction transversely to the axis of the sensor wire.

Such a system can be produced at relatively low cost, and can be deployed in a quick and convenient manner wherever the need arises. Moreover, by providing coupling members which permit free movement of the sensor wire in the longitudinal direction but restrains movement in the transverse direction, the sensor wire can be tensioned in long spans between widely-spaced wire supporting posts anchored in the ground, e.g., in spans of several hundred meters. This enables a minimum number of wire-supporting posts to be used, thereby further reducing the cost and simplifying the deployment of the barrier. Such an arrangement also reduces the sensitivity of the system to gradual forces, such as may be produced by the wind or the settling of the ground, thereby decreasing the number of false alarms.

While it is preferred to use coupling members permitting free longitudinal movement but restrained transverse movement of the sensor wire with respect to the coiled wire fence, an arrangement may be used wherein each of the coupling members fixedly attaches the respective point of the sensor wire to a part of the coiled wire fence. Such an arrangement provides greater sensitivity to detecting all disturbances, and also prevents the possibility of cutting the coiled wire fence and sliding it along the tensioned sensor wire in order to bypass the system.

In the preferred embodiment of the invention described below, the intrusion detector is carried by a detector carrier post anchored in the ground at an intermediate position with respect to the supporting posts; the intrusion detector including a housing fixed to the deteector carrier post, and a sensor member secured at its opposite ends to the sensor wire. Preferably, the detector carrier post is anchored midway between the wire-supporting posts, and the intrusion detector is a differential-type force transducer. Such an arrangement makes the detector relatively insensitive to gradual changes, e.g., because of temperature changes, wind, and the like, since the gradual changes on both sides of the detector tend to cancel each other, thereby reducing the number of false alarms.

In the described preferred embodiment, the coupling members are rings enclosing the sensor wire and a part of the coiled wire fence. Preferably, each of the rings is of sufficiently large diameter to permit the sensor wire to freely move therein with respect to the coiled wire fence in the longitudinal direction, but to restrain movement in the transverse direction. However, as noted above, an arrangement may be used wherein the rings tightly enclose the sensor wire and a part of the coiled wire fence to fix the sensor wire thereto.

Further features and advantages of the invention will be apparent from the description below.

BRIEF DESCRIPTION OF THE DRAWINGS

The invention is herein described, by way of example, with reference to the accompanying drawings, wherein:

FIG. 1 illustrates one form of deployable intrusion detector barrier constructed in accordance with the present invention;

FIG. 2 is an enlarged fragmentary view illustrating a part of the barrier of FIG. 1;

FIG. 3 is an enlarged fragmentary view illustrating one of the round-anchored wire-supporting posts in the barrier of FIG. 1;

FIG. 4 is an enlarged fragmentary view illustrating one of the ground-anchored detector-carrier posts in the barrier of FIG. 1; and FIG. 5 is an enlarged fragmentary view illustrating the variation wherein the coupling members are fixedly attached to the sensor wire.

DESCRIPTION OF A PREFERRED EMBODIMENT

The intrusion detection barrier illustrated in FIG. 1 comprises a coiled wire fence, generally designated 2, of any conventional construction, e.g., of the barbed wire type or of the razor foil type, loosely resting over the ground 4; and a sensor wire 6 tensioned between a pair of wire-supporting posts 8 anchored in the ground. The barrier further includes an intrusion detector 10 carried by a carrier post 12 also anchored in the ground at an intermediate position, preferably precisely midway, between two of the wire-supporting posts 8.

The barrier illustrated in FIG. 1 comprises two lengths of sensor wires 6, each tensioned between a pair of ground-anchored wire-supporting posts 8, and two detectors 10, each carried by a ground-anchored carrier post 12 located precisely midway between each pair of wire-supporting posts. It will be appreciated, however, that the barrier could include any desired number of sensor wires and disposed in any desired configuration, according to the area to be protected against intrusion.

The sensor wires 6 are coupled to the coiled wire fence 2 at spaced pointes along their lengths by a plurality of coupling members 14 which permit free movement of the sensor wire 6 with respect to the coiled wire fence 2 in the direction of the longitudinal axis of the sensor wire, but restrain the movement of the sensor wire with respect to the coiled wire fence in the direction transversely to the axis of the sensor wire. Coupling members 14 illustrated in the drawings are rings, sometimes called "hog rings", which enclose the sensor wire 6 and the wire of the coiled wire fence 2, and are of sufficiently large diameter to permit the sensor wire to freely move therein with respect to the coiled wire fence in the longitudinal direction, but restrain movement in the transverse direction. Accordingly, any movement of the coiled wire fence 2 in the transverse direction will increase the tension on the respective sensor wire 6, which increase in tension will be detected by the intrusion detector 10.

FIG. 3 more particularly illustrates one of the ground-anchored wire-supporting posts 8 to which one end of the respective tensioned sensor wire 6 is fixed. The wire-supporting post 8 is firmly anchored in the ground 4 and is braced against movement in either direction parallel to the longitudinal axis of the sensor wire 6 by diagonal posts 16 also anchored in the ground.

FIG. 4 more particularly illustrates the detector carrier post 12, and the intrusion detector 10 carried by that post. As shown in FIG. 4, the detector carrier post 12 is also anchored in the ground and is also braced against movement in either direction parallel to the sensor wires 6 by a pair of diagonal posts 18 also anchored in the ground.

Intrusion detector 10 is preferably of the differential-type force transducer, as described for example in U.S. Pat. No. 4,327,593. It includes a housing 20 secured to the detector carrier post 12 by a fastener 22, and a sensor member 24 secured at its opposite ends to the sensor wire 6 by another fastener 26. As described in U.S. Pat. No. 4,327,593, sensor member 24 includes a pair of force transducer units which produce electrical outputs corresponding to the rate of change of the force applied to the sensor unit 24, and when the forces are produced by wind or temperature changes, the forces applied to the sensor unit 24 are substantially equal and opposite, and therefore self-cancelling. Accordingly, the intrusion detector 10 is relatively insensitive to changes in tension in the sensor wires 6 produced by gradual temperature changes, wind, and the like, thereby reducing the rate of false alarms.

The illustrated intrusion detector barrier is applied to secure any desired area against intrusion by first deploying the coiled wire fence 2 to serve as a barrier with respect to the area to be protected. Then the wire-supporting posts 8 are anchored in the ground along spaced intervals, e.g., every several hundred metres, and a sensor wire 6 is secured in tension between each pair of the wire-supporting posts 8. The detector-carrier post 12 is then anchored in the ground midway between each pair of wire-supporting posts 8; the detector housing 10 is secured to the carrier post 12 by fastener 22; and the sensor member 24 of the detector is secured to the sensor wire 6 by fastener 26. The sensor wires 6 are then loosely coupled to the barbed wire fence 2 by a plurality of the rings 14 applied at spaced points along the lengths of the sensor wires 6 and the barbed wire fence 2.

As described above, the coupling rings 14 enclose the sensor wire and the respective wire of the coiled wire fence so as to permit free movement of the sensor wire with respect to the coiled wire fence in the direction of the longitudinal axis of the sensor wire, but restrain the movement of the sensor wires with respect to the coiled wire fence in the direction transversely to the axis of the sensor wires. Accordingly, wind, temperature changes, ground settling, and the like, will tend to be so gradual and/or self-cancelling because of their producing substantially equal and opposite forces on the sensor member 24, so that the detector 10 will be relatively insensitive to changes produced in the tension on the sensor wire 6 because of such affects. However, if a sensor wire 6 is cut, or the coiled wire fence 2 is moved, by someone attempting an intrusion, this will change the tension in the respective sensor wire 6, which change in tension will be detected by sensor member 24 of the respective detector 10, to sound an alarm or otherwise produce an indication of the attempted intrusion.

FIG. 5 illustrates the variation wherein the tensioned sensor wire, therein designated 116, is fixedly attached by coupling members 114 to spaced points of the coiled wire fence 102. For example, the coupling members 114 could also be in the form of rings, but tightly enclosing the sensor wire and the part of the coiled wire fixed thereto, so that any longitudinal movement as well as transverse movement of the fence 102 will be transferred to the sensor wire 116, and will therefore be detected by the detector (10 FIG. 1). In all other respects, the modification illustrated in FIG. 5 is the same as described above with respect to FIGS. 1-4.

While the invention has been described with respect to one preferred embodiment, it will be appreciated that many variations may be made. For example, the detector may be the switch-type rather than the force-type. The fence may include a plurality of coiled wires in a pyramid, or a coiled wire over another type fence to provide protection in depth. Further, there may be a plurality of sensor wires. Many other variations, modifications and applications of the invention will be apparent.

What is claimed is:

1. An intrusion detection barrier, comprising: a coiled wire fence deployable over the ground or over another fence; a sensor wire tensioned between a pair of wire-supporting posts anchored in the ground; an intrusion detector connected to said sensor wire to sense any change in tension thereof; and coupling members coupling said sensor wire to spaced points of said coiled wire fence.

2. The intrusion detection barrier according to claim 1, wherein each of said coupling members permits free movement of the sensor wire with respect to the coiled wire fence in the direction of the longitudinal axis of the sensor wire, but restrains movement of the sensor wire with respect to the coiled wire fence in the direction transversely to the longitudinal axis of the sensor wire.

3. The intrusion detection barrier according to claim 2, wherein said coupling members are rings enclosing the sensor wire and a part of the coiled wire fence, each of said rings being of sufficiently large diameter to permit the sensor wire to freely move therein with respect to the coiled wire fence in the longitudinal direction, but to restrain movement in the transverse direction.

4. The intrusion detection barrier according to claim 1, wherein each of said coupling members fixedly attaches the respective point of the sensor wire to a part of the coiled wire fence.

5. The intrusion detection barrier according to claim 4, wherein each of said coupling members comprises a ring tightly enclosing the sensor wire and the part of the coiled wire fence to which it is attached.

6. The intrusion detection barrier according to claim 1, wherein said intrusion detector is carried by a detector carrier post anchored in the ground at an intermediate position with respect to said supporting posts; said intrusion detector including a housing fixed to said detector carrier post, and a sensor member secured at its opposite ends to the sensor wire.

7. The intrusion detection barrier according to claim 6, wherein said detector carrier post is anchored midway between said wire supporting posts.

8. The intrusion detection barrier according to claim 1, wherein said intrusion detector is a force detector.

9. The intrusion detection barrier according to claim 1, wherein said intrusion detector is a switch detector.

10. The intrusion detection barrier according to claim 1, wherein said coiled wire fence is a barbed wire fence.

11. The intrusion detection barrier according to claim 1, wherein said coiled wire fence is a razor foil fence.

12. An intrusion detection barrier, comprising: a coiled wire fence deployable over the ground or over another fence; a sensor wire tensioned between a pair of wire-supporting posts anchored in the ground; an intrusion detector carrier by a detector carrier post anchored in the ground at an intermediate position with respect to said supporting posts; and a plurality of coupling members coupling said sensor wire to spaced points of said coil wire fence such that any movement of the coiled wire fence in the transverse direction will change the tension of the sensor wire; said intrusion detector including a housing fixed to said detector carrier post, and a sensor member secured at its opposite ends to the sensor wire.

13. The intrusion detection barrier according to claim 12, wherein said detector carrier post is anchored midway between said wire supporting posts.

14. The intrusion detection barrier according to claim 12, wherein each of said coupling members permits free movement of the sensor wire with respect to the coiled wire fence in the direction of the longitudinal axis of the sensor wire, but restrains movement of the sensor wire with respect to the coiled wire fence in the direction transversely to the longitudinal axis of the sensor wire.

15. The intrusion detection barrier according to claim 14, wherein said coupling members are rings enclosing the sensor wire and a part of the coiled wire fence, each of said rings being of sufficiently large diameter to permit the sensor wire to freely move therein with respect to the coiled wire fence in the longitudinal direction, but to restrain movement in the transverse direction.

16. The intrusion detection barrier according to claim 12, wherein each of said coupling members fixedly attaches the respective point of the sensor wire to a part of the coiled wire fence.

17. The intrusion detection barrier according to claim 16, wherein each of said coupling members comprises a ring tightly enclosing the sensor wire and the part of the coiled wire fence to which it is attached.

18. The intrusion detection barrier according to claim 12, wherein said intrusion detector is a force detector.

19. The intrusion detection barrier according to claim 12, wherein said intrusion detector is a switch detector.

20. The intrusion detection barrier according to claim 12, wherein said coiled wire fence is a barbed wire fence.

* * * * *